US005104314A

United States Patent [19]

Amore

[11] Patent Number: 5,104,314

[45] Date of Patent: Apr. 14, 1992

[54] REFRACTORY HEARTH FURNACE FLOOR ARRANGEMENT FOR RETAINING AN ALLOY CHAIN AND PUSHER ASSEMBLY

[76] Inventor: Leonard M. Amore, 3130 Linda Dr., Flint, Mich. 48507

[21] Appl. No.: 587,816

[22] Filed: Sep. 24, 1990

[51] Int. Cl.[5] ..... F27D 3/00; F27B 9/00; C21D 1/06

[52] U.S. Cl. ..... 432/121; 432/239; 266/252; 266/255

[58] Field of Search ..... 432/121, 128, 144, 147, 432/153, 239, 245, 246; 266/252, 255

[56] References Cited

U.S. PATENT DOCUMENTS

| | | | |
|---|---|---|---|
| 2,891,659 | 6/1959 | Westeren | 266/255 X |
| 3,995,990 | 12/1976 | Dwyer et al. | 432/121 |
| 4,375,354 | 3/1983 | Henriksson | 432/239 |
| 4,401,297 | 8/1983 | Doi et al. | 266/252 |
| 4,421,481 | 12/1983 | Holz et al. | 432/239 |
| 4,496,312 | 1/1985 | Yamada et al. | 432/128 X |
| 4,589,845 | 5/1986 | Naohara et al. | 432/239 |
| 4,601,660 | 7/1986 | Schuster | 432/239 |
| 4,802,844 | 2/1989 | Kuhn et al. | 432/241 X |

FOREIGN PATENT DOCUMENTS

| | | | |
|---|---|---|---|
| 1174316 | 8/1986 | Japan | 266/252 |

*Primary Examiner*—Henry A. Bennett
*Assistant Examiner*—Christopher B. Kilver
*Attorney, Agent, or Firm*—Donald C. Bolger

[57] ABSTRACT

A refractory hearth for use in an industrial heat treat furnace is disclosed whereby the hearth contains no alloy parts with the exception of the pusher assembly and the roller chain attached to it. L-shaped ceramic, refractory or silicon carbide tile are placed in position to support material being heat treated, while at the same time preventing the roller chain from rising up out of place. The outside edges of said L-shaped tile shall act as guides to move stock trays in a straight path. Refractory material used to hold hearth in place will also support radiant tubes used to supply heat.

16 Claims, 4 Drawing Sheets

REFRACTORY HEARTH FURNACE FLOOR ARRANGEMENT FOR RETAINING AN ALLOY CHAIN AND PUSHER ASSEMBLY

Cross-references to Related Applications: None.

Statement as to right to inventions made under Federally sponsored research and development: Not Applicable.

BACKGROUND OF THE INVENTION

The field of the invention is generally that of roller chain pushers for a batch type allcase furnace, and more specifically, to an improved refractory hearth furnace floor arrangement for retaining an alloy chain and pusher assembly.

In typical batch type allcase furnaces, work pieces are placed in a stock tray, which is moved into the furnace chamber for heating and then into a vestibule or elevator for quenching. It is conventional to move stock trays on an alloy roller assembly supported by alloy plates and/or refractory. An alloy pusher assembly chain is held in a working area by alloy plates placed over the rollers of the chain. Such arrangements are conventionally referred to as roller rail hearths. Radiant tubes used to heat the furnace chamber are supported by alloy brackets bolted to the outside furnace wall.

At present, it is not uncommon for batch type allcase furnaces to reach temperatures of 2000 degrees F. When the conventional roller hearth is subjected to these temperatures the thermal stress coupled with heavy loads in excess of 1000 pounds will cause permanent distortion of roller rails and plates. Alloy parts have an expected life span of between 12 & 18 months when used on a continual basis at these high temperatures.

Refractory hearths are used in other heat treat processes, but are not designed to support stock while at the same time guide the stock tray in a straight line and provide a hold down area for the roller chain and pusher.

These hearths are generally used in conjunction with pushers that move stock in one direction. These pushers are either a solid hydraulic driven rod type pusher, or a chain pusher with no rollers. The chain laying down on its side, so that it braces itself against refractory material on both sides.

The problem has always been to design a hearth to hold down the chain that was both economical and long lasting, but was easy to replace. Most batch type furnaces operating at 1700 degree F. or higher require replacement of alloy 5 to 6 times during the expected 8 to 10 year life span of the refractory brick used to insulate the heat chamber walls.

SUMMARY OF THE INVENTION

It is a principle object of the present invention to provide a high capacity refractory hearth for use in an industrial heat treating furnace operating at elevated temperatures.

This object along with other features of this invention is achieved in a conventionally constructed batch type heat treat furnace, which has an insulated heat chamber, a door into the furnace chamber for entry an exit of the work, conventional heating means to provide heat to the atmosphere in the furnace, a circulating fan with means to circulate the atmosphere in the heat chamber, and means to supply a heat treat atmosphere to the furnace chamber.

A conventional stock tray is drawn by a conventional pusher head with roller chain in and out of the furnace chamber. This work tray, while in the furnace chamber, is resting on a refractory floor that consists of L--shaped (ceramic), (silicon carbide) pieces that are braced in place by strategically placed pieces of refractory that center them in their proper position and height.

The outside edges of the L-shaped pieces shall be measured and placed precisely to act as guides to keep the stock tray in a parallel line with the pusher and chain.

The pusher head and attached roller chain shall move in a work area that is formed by the L-shaped pieces and aligned pieces of tile that the chain rolls on. The L-shaped tile shall be measured and placed so that they also provide a cover for the roller chain and attached pusher head to keep them from rising up out of place when the chain pushes them.

The refractory hearth shall extend from the door of the furnace to the other end of furnace chamber, where the chain recedes into the chain storage area.

The top of the refractory hearth will be even with alloy rollers that are outside the furnace chamber, but in the vestibule outside the furnace chamber door.

The refractory hearth shall be blocked in place by refractory brick placed at joints where L-shaped pieces and tile meet each other end to end. The refractory brick blocking will extend from the hearth to the side insulating fire brick walls.

The blocking or spacer brick near the insulating fire brick walls that insulate the furnace will maintain a measured height to support in a level position the two bottom radiant tubes used to supply the heat to the furnace chamber.

It is an object of the present invention to provide a novel durable, long lasting hearth surface that will last through the lifetime of the refractory insulation brick used in heat chamber walls.

It is a further object of the invention to allow roller chain and pusher to be held in working area by a refractory material rather than alloy.

It is another object of the invention to provide a guide for stock tray to move in and out of heat chamber without moving out of alignment.

It is a further object of the invention to provide for lower radiant tubes to be supported by refractory rather than alloy tube supports.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

Figure 1:
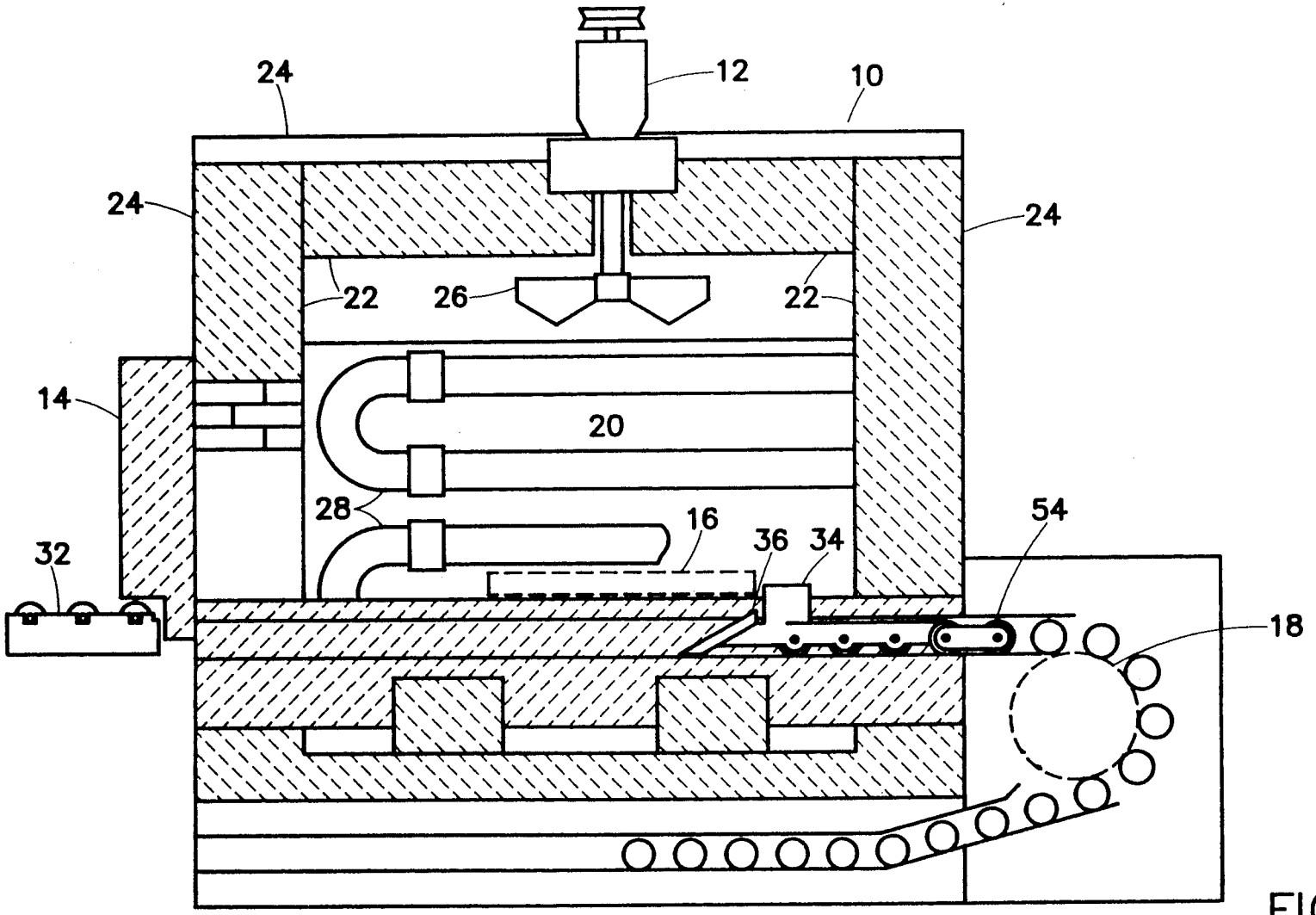
FIG. 1 is a cross sectional side view of a batch type allcase furnace.

Referring now to the drawings wherein the showings are for the purpose of illustration a preferred embodiment of the invention only and not for the purpose of limiting the same, FIG. 1 shows a conventional, batch type allcase heat treat furnace 10. Furnace 10 includes a fan drive assembly 12, a furnace door 14, a stock tray 16, a chain drive mechanism 18, an alloy roller chain assembly 54, a furnace chamber 20, insulating fire brick 22, furnace case 24, fan blade 26, radiant tubes 28, radiant tubes alloy support 30, (See FIG. 2), alloy roller and support assembly 32, pusher 34, and trip lever 36.

Furnace door 14 is provided for sealing heat and atmosphere in furnace chamber 20. The work comprises parts that are stacked into stock tray 16. Stock tray 16 is drawn into the furnace by engaging trip lever 36 which hooks under stock tray 16 and allows alloy roller chain assembly 54 driven by chain drive mechanism 18 to pull stock tray 16 into furnace chamber 20. Alloy roller chain assembly 54 has attached pusher 34 which pushes stock tray 16. After heat treat, chain drive mechanism 18 is reversed and pusher 34 pushes stock tray 16 out of the furnace.

Figure 2:
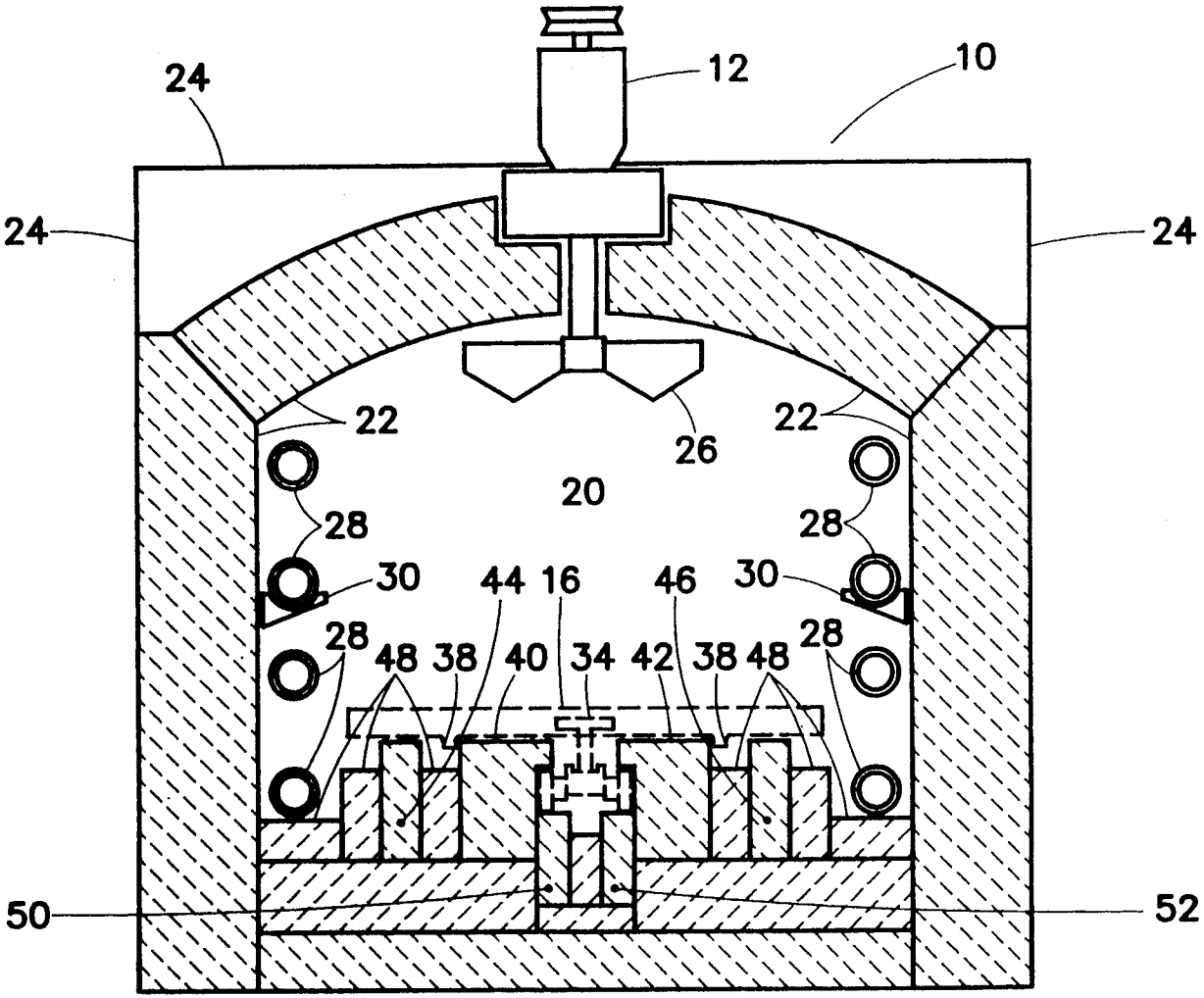
FIG. 2 is a cross sectional end view of a batch type allcase furnace.

Referring to FIG. 2, insulating fire brick 22 enclose furnace chamber 20 and are covered with furnace case 24. A fan drive assembly 12 and fan blade 26 circulate heat from radiant tubes 28 and enclosed gas atmosphere. At the bottom of furnace chamber 20, is a floor arrangement for retaining alloy roller chain assembly 54 and pusher 34.

Figure 3:
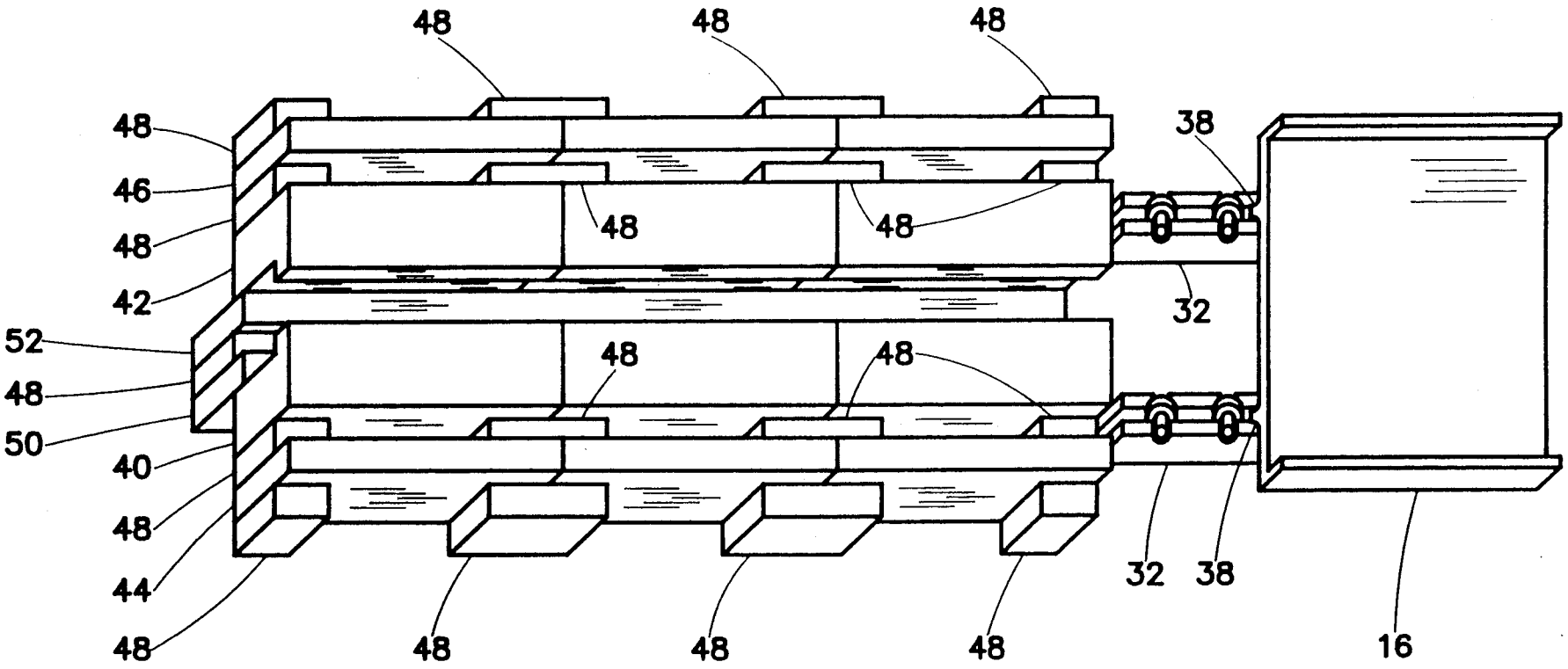
FIG. 3 is perspective view of a refractory hearth floor.
Figure 4:
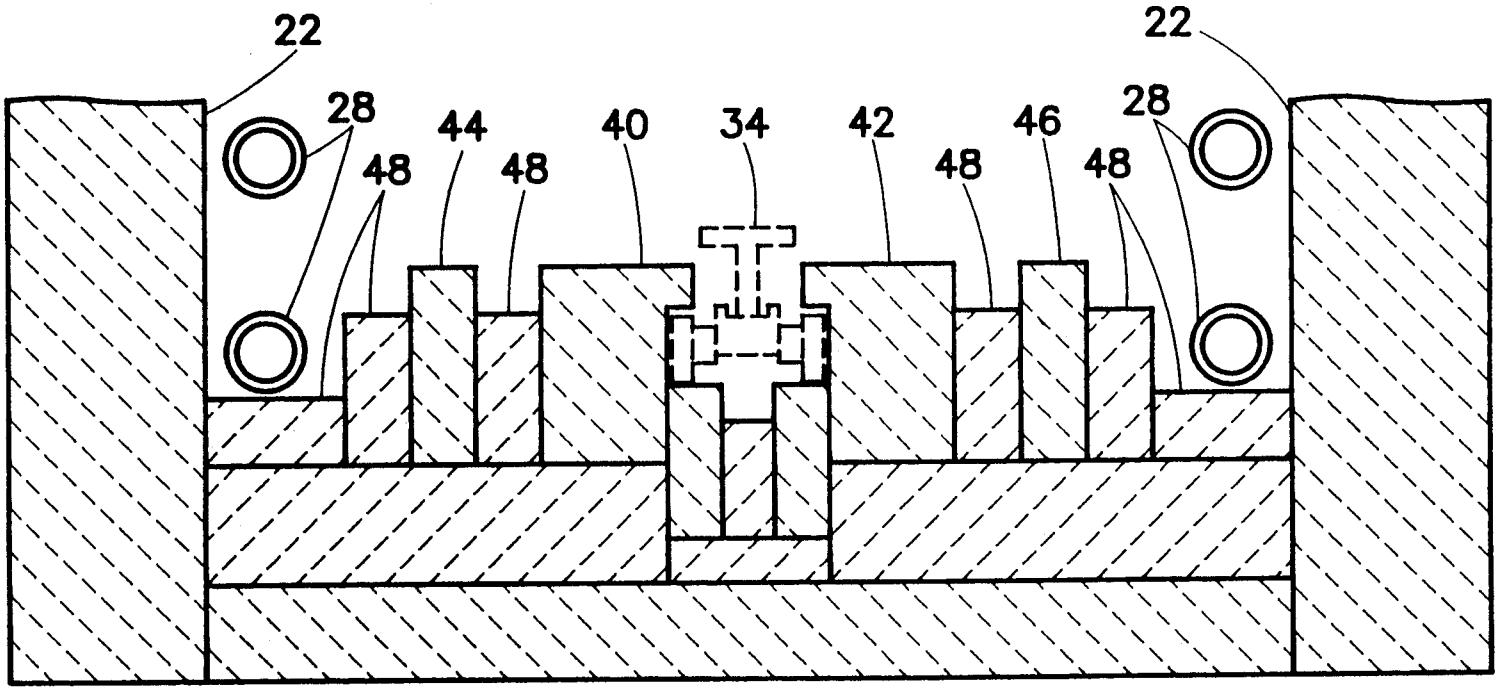
FIG. 4 is a partial cross section end view a batch type allcase furnace.

Referring to FIG. 3, stock tray 16 has stock tray guides 38 to align with measured outside edges of left retainer brick 40 and right retainer brick 42. This will ensure proper alignment of stock tray 16 when it is pulled in and pushed out of the furnace chamber 20. The floor arrangement is comprised of left retainer brick 40, right retainer brick 42, left tile brick 44, right tile brick 46, spacer bricks 48, left lower support brick 50, right lower support brick 52. In some cases, left tile brick 44 and right tile brick 46 could support stock tray 16.

Alloy roller chain assembly 54 and pusher 34 are held in place by left retainer brick 40, right retainer brick 42, left lower support brick 50, and right lower support brick 52 (See FIG. 2). The left lower support brick 50 and the right lower support brick 52 are aligned with chain drive mechanism 18 to allow even movement of alloy roller chain assembly 54 and pusher 34. This eliminates the alloy material that is in conventional furnaces and provides a durable, long lasting hearth floor surface that will last through the lifetime of the refractory insulating brick used in heat chamber walls.

Stock tray 16 has stock tray guides 38 that provide for stock tray 16 to align with measured outside edges of left retainer brick 40 and right retainer brick 42. This helps stock tray 16 to move in and out of furnace chamber 20 without moving out of alignment. The lower radiant tubes 28 rest on spacer bricks 48 and provide for the lower radiant tubes 28 to be supported by refractory material spacer bricks 48 instead of conventional alloy supports.

What is claimed is:

1. A batch type furnace hearth arrangement in combination with a retractable alloy roller chain and pusher assembly for use in an industrial allcase heat treat furnace having a furnace chamber surrounding said hearth into which metallic workpieces placed in a stock tray are to be treated, said arrangement comprising:

a left retainer brick;

a right retainer brick;

a lower support brick;

whereby said retainer bricks prevent lateral movement of said alloy roller chain and said support brick supports weight of said alloy roller chain; and means for retaining said left retainer brick a fixed distance from right retainer brick whereby a retractable alloy roller chain and pusher assembly can be guided while moving said stock tray in and out of said furnace.

2. A batch type furnace hearth arrangement as recited in claim 1, wherein the cross-sectional profile of said alloy roller chain and pusher assembly is removed from facing portions of said left retainer brick and said right retainer brick, whereby said left retainer brick and said right retainer brick guide said alloy roller chain and pusher assembly in and out of said furnace.

3. A batch type furnace hearth arrangement as recited in claim 1, wherein a rectangular section is removed from facing sections of said left retainer brick and said right retainer brick, whereby said alloy roller chain and pusher assembly is guided in and out of said furnace.

4. A batch type furnace hearth arrangement as recited in claim 1, wherein facing sections are removed from said left retainer brick and said right retainer brick.

5. A batch type furnace hearth arrangement as recited in claim 1, wherein a rectangular section is removed from facing sections of said left retainer brick and from said right retainer brick.

6. A batch type furnace hearth arrangement in combination with a retractable alloy roller chain and pusher assembly for use in an industrial allcase heat treat furnace having a furnace chamber surrounding said hearth into which metallic workpieces placed in a stock tray are to be treated, said arrangement comprising:

a left retainer brick;

a right retainer brick;

a left lower support brick;

a right lower support brick;

whereby said retainer bricks prevent lateral movement of said alloy roller chain and said support bricks support weight of said alloy roller chain; and means for retaining said left retainer brick a fixed distance from right retainer brick, said left lower support brick adjacent to said left retainer brick, and said right lower support brick adjacent to said right retainer brick whereby a retractable alloy roller chain and pusher assembly can be guided while moving said stock tray in and out of said furnace.

7. A batch type furnace hearth arrangement as recited in claim 6, whereby at least one spacer brick is used to retain said left retainer brick a fixed distance from said right retainer brick.

8. A batch type furnace hearth arrangement as recited in claim 6, wherein the cross-sectional profile of said alloy roller chain and pusher assembly is removed from facing portions of said left retainer brick and said right retainer brick, whereby said left retainer brick and said right retainer brick guide said alloy roller chain and pusher assembly in and out of said furnace.

9. A batch type furnace hearth arrangement as recited in claim 6, wherein a rectangular section is removed from facing portions of said left retainer brick and said right retainer brick, and said left support brick and said right retainer brick, and said left support brick and said right support are arranged to support the weight of said alloy roller chain and pusher assembly and whereby said alloy roller chain and pusher assembly is guided in and out of said furnace.

10. A batch type furnace hearth arrangement as recited in claim 6, wherein a rectangular section is removed from facing portions of said left retainer brick and said right retainer brick and said left support brick and said right brick is arranged for guiding said alloy roller chain and pusher assembly in and out of said furnace.

11. A batch type furnace hearth arrangement as recited in claim 6, wherein a rectangular section is removed from facing portions of said left retainer brick and from said right retainer brick.

12. A batch type furnace hearth arrangement in combination with a retractable alloy roller chain and pusher assembly for use in an industrial allcase heat treat furnace having a furnace chamber surrounding said hearth into which metallic workpieces placed in a stock tray are to be treated, said arrangement comprising:

a left retainer brick;

a right retainer brick;

a left lower support brick;

a right lower support brick;

a left tile brick;

a right tile brick;

whereby said retainer bricks prevent lateral movement of said alloy roller chain and said support bricks support weight of said alloy roller chain; and means for retaining said left retainer brick a fixed distance from right retainer brick, said left lower support brick adjacent to said left retainer brick, and said right lower support brick adjacent to said right retainer brick, said left tile brick a fixed distance from said left retainer brick, said right tile brick a fixed distance from said right retainer brick, whereby a retractable alloy roller chain and pusher assembly and stock tray can be guided while moving said stock tray in and out of said furnace.

13. A batch type furnace hearth arrangement as recited in claim 12, whereby at least one spacer brick is used to retain said left retainer brick a fixed distance from said right retainer brick and whereby at least one spacer brick is used to retain said left tile brick a fixed distance from left retainer brick and whereby at least one spacer brick is used to retain said right tile brick a fixed distance form right retainer brick.

14. A batch type furnace hearth arrangement as recited in claim 12, wherein the cross-sectional profile of said alloy roller chain and pusher assembly is removed from facing portions of said left retainer brick and said right retainer brick, whereby said left retainer brick and said right retainer brick guide said alloy roller chain and pusher assembly in and out of said furnace.

15. A batch type furnace hearth arrangement as recited in claim 12, wherein a rectangular section is removed from facing portions of said left retainer brick and said right tile brick, and said left tile brick and said right support are arranged to support the weight of said alloy roller chain and pusher assembly and whereby said alloy roller chain and pusher assembly is guided in and out of said furnace.

,17

16. A batch type furnace hearth arrangement as recited in claim 12, wherein a rectangular section is removed from facing portions of said left retainer brick and said right retainer brick and said left tile brick and said right tile brick is arranged for guiding said alloy roller chain and pusher assembly in and out of said furnace.

* * * * *